US007759871B2

(12) United States Patent
Chowdhury et al.

(10) Patent No.: US 7,759,871 B2
(45) Date of Patent: Jul. 20, 2010

(54) HIGH TEMPERATURE SEAL FOR ELECTRIC LAMP

(75) Inventors: Ashfaqul Islam Chowdhury, Broadview Heights, OH (US); Roger Hume, Melton Mowbray (GB); Barry Preston, Melton Mowbray (GB); Rajasingh Israel, Westlake, OH (US); Tianji Zhao, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 1043 days.

(21) Appl. No.: 11/303,284

(22) Filed: Dec. 16, 2005

(65) Prior Publication Data

US 2007/0138962 A1 Jun. 21, 2007

(51) Int. Cl.
*H01J 17/18* (2006.01)

(52) U.S. Cl. ..... 313/623; 313/318.07; 313/626

(58) Field of Classification Search ..... 313/318.07, 313/623–626
See application file for complete search history.

(56) References Cited

U.S. PATENT DOCUMENTS

| | | | | |
|---|---|---|---|---|
| 3,420,944 | A * | 1/1969 | Holcomb | 313/318.12 |
| 3,515,420 | A | 6/1970 | Thomasson et al. | |
| 3,753,026 | A | 8/1973 | Goorissen | |
| 3,793,615 | A | 2/1974 | Homonnay et al. | |
| 4,539,509 | A | 9/1985 | Varshneya | |
| 4,749,902 | A | 6/1988 | Weiss | |
| 4,835,439 | A | 5/1989 | Essock et al. | |
| 5,021,711 | A * | 6/1991 | Madden et al. | 313/623 |
| 5,310,374 | A | 5/1994 | Tomoyuki | |
| 5,387,840 | A | 2/1995 | Noteleteirs et al. | |
| 5,402,038 | A | 3/1995 | Parham et al. | |
| 6,336,837 | B1 | 1/2002 | Maeda | |
| 6,583,562 | B1 | 6/2003 | Gubbels | |
| 2002/0008477 | A1 | 1/2002 | Leichtfried et al. | |
| 2002/0167086 | A1 * | 11/2002 | Stauf et al. | 257/751 |
| 2003/0064244 | A1 * | 4/2003 | Scarlin et al. | 428/681 |
| 2004/0036415 | A1 * | 2/2004 | Kai et al. | 313/626 |
| 2004/0126237 | A1 * | 7/2004 | Jackson et al. | 416/97 R |
| 2005/0174058 | A1 | 8/2005 | Coumans et al. | |
| 2006/0141806 | A1 * | 6/2006 | Waldfried et al. | 438/778 |

FOREIGN PATENT DOCUMENTS

WO WO 03/105177 A2 12/2003

OTHER PUBLICATIONS

Emilsson, T., et al., "Oxidation Protection of Mo Sealing Foils Using Fused Silica Coatings", Light Sources 2004, LS 10 Proceedings, Toulouse, France, Jul. 2004, IOP Conf. Series No. 182, ISBN 0750310073, pp. 503-504, Jul. 2004.
"Staying cool when things hot up", Osram GmbH, p. 1-4, dated prior to Jun. 9, 2005.
"See the World in a New Light", Osram GmbH, p. 1-4, Jun. 9, 2005.

* cited by examiner

*Primary Examiner*—Bumsuk Won
(74) *Attorney, Agent, or Firm*—Pearne & Gordon LLP

(57) ABSTRACT

An improved seal for an electric lamp is provided. An oxidation-resistant coating is provided on the current conductor where the outer lead joins the seal foil, preferably at the pinch seal. The coating is preferably a chromium layer covered by a chromium layer or a silver layer covered by a layer of hydrogenated silicon oxy carbon polymer. The coating is preferably applied via sputtering where the coating is subject to high energy electron or ion bombardment during sputtering. Preferably the coating is applied via sputtering at increased deposition pressure.

15 Claims, 1 Drawing Sheet

HIGH TEMPERATURE SEAL FOR ELECTRIC LAMP

FIELD OF THE INVENTION

The invention relates generally to electric lamps and more particularly to a seal for a current conductor for an electric lamp.

DESCRIPTION OF RELATED ART

Electric lamps are equipped with current conductors to conduct the supply current required to operate the lamp. The current conductor often includes an outer lead, a seal foil and an inner lead (e.g. electrode, filament). The outer lead enters the lamp and is connected or welded to the foil, which is commonly composed of molybdenum. The foil is often a thin, rectangular piece of molybdenum with edges that typically taper at the ends. The foil and leads are pinched or sealed or fused at the ends of the lamp envelope (i.e. pinch point) in a vacuum-tight manner so that the internal chamber of the lamp is effectively a sealed volume. During lamp operation, the pinch point and foil are exposed to thermal stresses that can crack the seal or oxidize the foil and leads, which reduce the service life of the lamp. Therefore, to extend the service life of the lamp, it is desirable that the foil and leads be capable of withstanding high operating temperatures.

The light produced by electric lamps creates large quantities of heat, thereby exposing the molybdenum foil and leads in the pinch point to elevated temperatures. Particularly, the foil may be exposed to air or gas retained in the seal and any gaps in the seal permit air to enter the seal. At approximately 300-350° C., the molybdenum will start to oxidize in the presence of oxygen. Consequently, oxidation of the molybdenum can cause the thickness of the foil to increase and eventually crack the pinch seal, thus ending the service life of the lamp. Currently, the maximum temperature at which pinch seals are generally resistant to thermal stresses is approximately 500° C. Above this operating temperature range, foils experience higher rates of oxidation and degradation. Thus, in order to keep the pinch temperature below the maximum operating temperature, it is frequently necessary to force cool the lamps during operation. Force cooling may include the use of positive displacement fans, which increase the overall fixture (luminaire) noise levels. This excess noise is undesirable in various applications, including the entertainment, sports, studio and news industries.

Accordingly, there is a need in the industry for an improved seal that can withstand high thermal loads generated during lamp operation. There is also a need for a foil and/or lead that is resistant to oxidation and corrosion at elevated lamp operating temperatures.

SUMMARY OF THE INVENTION

An electric lamp is provided which comprises an electric light source and the current conductor connected to the electric light source. The current conductor comprises an outer lead joined to a seal foil at an outer lead-seal foil junction. A first section of the current conductor including the junction is sealed within outer seal material. The first section of the current conductor inside the outer seal material is coated with an oxidation-resistant coating comprising (a) a layer of material applied via sputtering wherein the layer of material is subject to high energy electron or ion bombardment during sputtering or (b) a layer of hydrogenated silicon oxy carbon polymer or (c) at least two layers of material. A process for providing a current conductor coated with an oxidation-resistant coating is also provided.

DETAILED DESCRIPTION OF THE PREFERRED EMBODIMENTS OF THE INVENTION

In the description that follows, when a preferred range, such as 5 to 25 (or 5-25), is given, this means preferably at least 5 and, separately and independently, preferably not more than 25.

Figure 1:
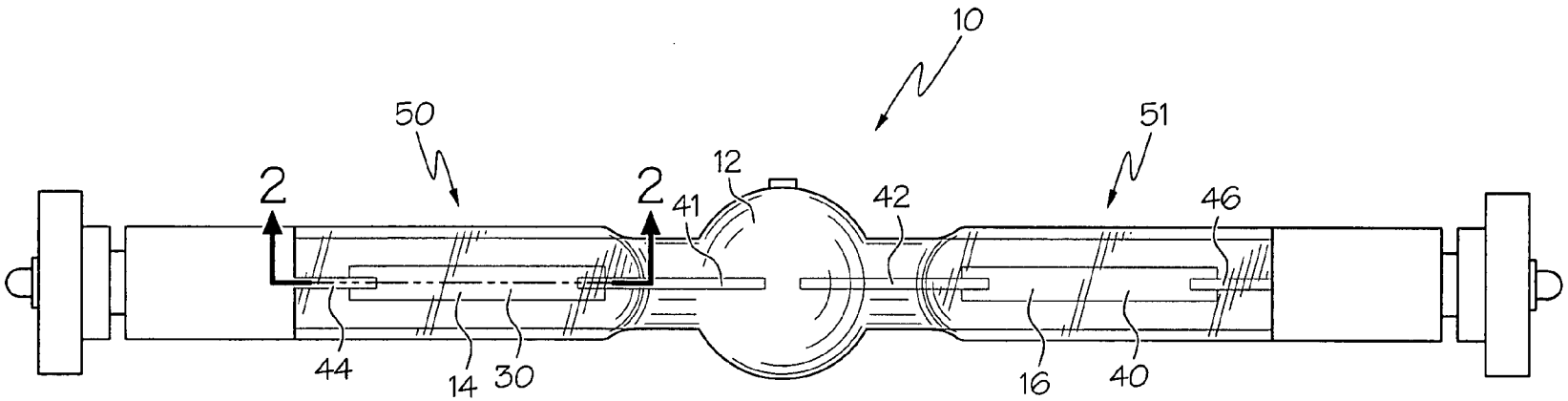
FIG. 1 shows diagrammatically an electric lamp according to the present invention.

With reference to FIG. 1, there is shown an electric lamp 10, which in this case is an arctube. The present invention can be used in many kinds of electric lamps, such as incandescent lamps and halogen incandescent lamps, quartz and ceramic discharge arctubes, discharge lamps or arc lamps such as quartz metal halide lamps, mercury discharge lamps and ceramic metal halide lamps, high intensity and high pressure discharge lamps (such as 10-100 or 50-100 atm during operation). The invention can be used for seals for the outer jacket or envelope of discharge and other electrical lamps. The invention can be used for stage, studio, auto, aircraft, stadium and search light lamps, such as General Electric discharge entertainment and other halogen stage and studio lamps. The invention is particularly useful in lamps having wattages or designed to operate or operating at wattages of 20-40,000 or 400-10,000 or 400-3000 or 650-2000 or 700-1500 or 700-1200, watts.

Electric lamp 10 includes an electric light source 12, in this case an arc chamber where the light-emitting arc is produced. The arc chamber generally contains a fill as known in the art. In other electric lamps the electric light source may be a filament such as a tungsten filament in an incandescent lamp. Electric lamp 10 includes current conductor 14 comprising outer lead 44, seal foil 30 and inner lead or electrode 41. As shown, current conductor 14 is electrically connected electric light source 12. Electric lamp 10 includes current conductor 16 comprising outer lead 46, seal foil 40 and inner lead or electrode 42. Lamp 10 also includes pinch seal sections 50 and 51 having flattened cross sections. The seal foils 30, 40 are known in the art and are preferably molybdenum, alternatively molybdenum alloy or molybdenum doped with yttrium and/or yttrium oxides. The current conductors 14, 16 connect the electrodes or electric light source to an external electrical power source.

Though the lamp in FIG. 1 is linear, the invention may be used in lamps of any shape and any cross section. Furthermore, the representative lamp assembly of FIG. 1 can have various sizes, shapes and electrode or filament configurations. The lamp or arctube 10 is typically quartz or ceramic as known in the art.

A common feature of the lamps considered herein is a press or pinch seal with a current conductor which acts as an electrical feed through. Preferably, in order to ensure a hermetic seal 50, 51 of the lamp interior region, the foil 30, 40 edges are feathered or tapered. As such, the feathered foil edges are more easily fused to the outer seal material or vitreous material at the seals 50, 51. The length and thickness of the foil is selected based on the desired lamp operating current.

Figure 2:
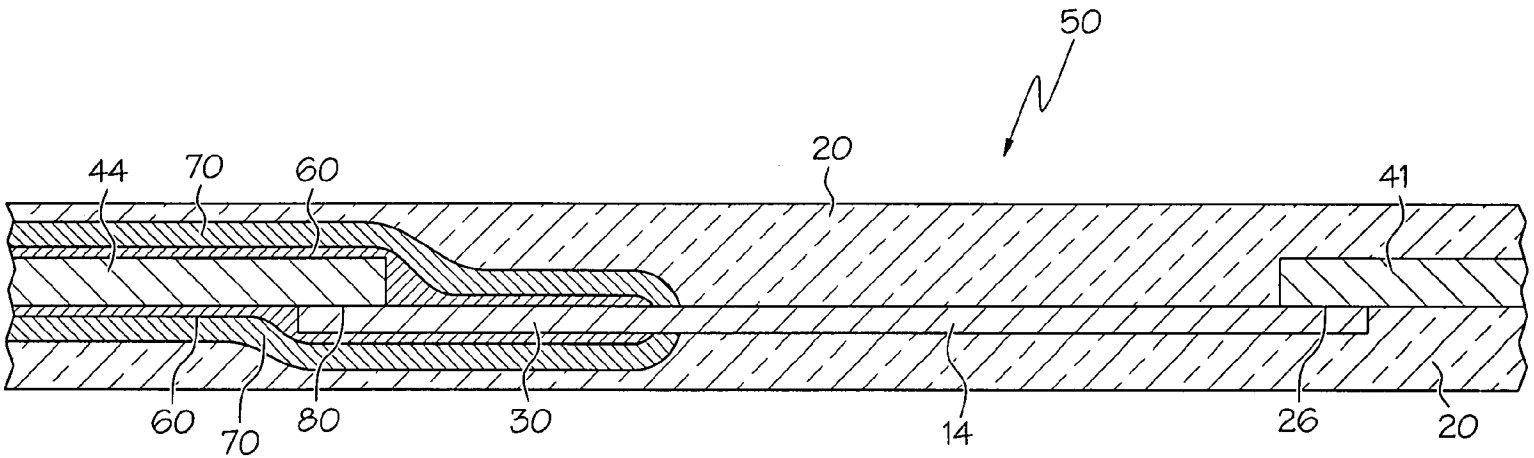
FIG. 2 shows diagrammatically a cross-section view taken along line 2-2 of FIG. 1.

With reference to FIG. 2 there is shown outer lead 44, seal foil 30 and inner lead 41 located in pinch seal section 51. Outer lead 44 is connected or joined to seal foil 30 at an outer lead-seal foil junction by weld 80 or other conventional connection. Similarly, seal foil 30 is connected or joined to inner lead 41 at an inner lead-seal foil junction by weld 26 or other conventional connection. Alternatively, an outer lead can be joined to a seal foil at a junction by taking a unitary wire and flattening a portion to form a seal foil, thus producing an outer lead jointed to a seal foil at a junction. As shown, all or a portion of outer lead 44 and a portion of seal foil 30 are coated or encased or covered or overlaid by or with an oxidation-resistant coating comprising first layer 60 and second layer or topcoat layer 70, preferably in direct contact as shown. Optionally, the oxidation-resistant coating can include other layers provided underneath, between, and/or over the layers 60 and 70. The section of current conductor 14 shown is sealed within outer seal material 20, which is typically quartz or other vitreous seal material as known in the art. Although FIG. 2 shows only a portion of foil 30 coated with layers 60, 70, at least (preferably starting from the left end of foil 30 in FIG. 2) 20, 30, 40, 50, 60, 70, 80, 90 or 100% of the length of foil 30 can be coated or covered with layers 60 and/or 70. Optionally, a portion of inner lead 41 can be coated also.

The invented coating is particularly useful for electric lamps operating at 350-800° C., 400-750° C., 450-750° C., 475-750° C., 500-700° C., 525-675° C., 550-750° C., 550-700° C., 550-650° C., 570-630° C., 575-625° C., or about 600° C., the temperature being measured at the outer lead-seal foil junction as known in the art.

As discussed above, the oxidation of molybdenum in a seal at elevated temperatures, particularly above 500° C., can significantly reduce the service life of a lamp. As will be seen below, the invented coating has been found to be effective to prevent or inhibit or resist oxidation of molybdenum foils and leads at temperatures of 650° C. (measured at the outer lead-seal foil junction) for at least 600, 700, 800, 900, 1000, 1200 and 1300 hours.

Use of the present invention can reduce the rate of oxidation and corrosion of the seal foil, increase the thermal load the lamp can withstand, reduce the need for forced cooling, reduce the noise associated with forced cooling, and permit smaller, more compact designs operating at higher temperature and thermal loads.

The invented coating and its manner of application reduces the number of pinholes and voids which can expose the underlying current conductor to atmospheric oxygen that can be trapped in the pinch seal. Often cracks or cavities around the outer lead and foil form during seal pressing. These cracks or cavities allow air to come into contact with the outer lead and foil which can lead to oxidation. Preferably, the coating forms a continuous seal around the entire perimeter of the current conductor in the pinch seal, wherein the current conductor does not react with any residual air in the pinch seal or surrounding outside environment.

The materials of the first layer 60 and the topcoat layer 70 can include chromium, chromium-nickel alloys, chromium-nickel alloys doped with rare earth metal, chromium-nickel alloys doped with yttrium, chromium-manganese alloys, chromium-cobalt alloys, chromium-iron alloys, chromium-boron alloys, titanium, titanium oxide, titanium oxide alloys, silver, platinum, platinum-iridium alloy, hydrogenated silicon oxycarbide, hydrogenated silicon oxy carbon polymer and combinations thereof. Preferably, the first layer 60 is comprised of substantially pure chromium, chromium-nickel alloy or silver. The topcoat layer 70 is preferably comprised of substantially pure chromium, chromium-nickel alloy or hydrogenated silicon oxy carbon polymer. The hydrogenated silicon oxy carbon polymer is preferably deposited via PECVD (Plasma Enhanced Chemical Vapor Deposition) from Wacker Silicone Fluid AK 0.65 (99%+HMDSO, <0.5 ppm Cl) supplied by Wacker Chemical Corporation, Adrian, Mich., or alternatively hexamethyldisiloxane 99%+(<0.5 ppm Cl) supplied by Alfa Aesar, Ward Hill, Mass.

The individual layers of the invented coating can be of varying thicknesses. Preferably, the first layer 60 has a thickness of 100-2500 angstroms, preferably 200-2000 angstroms, preferably 300-1500 angstroms, preferably 400-1250 angstroms, preferably 500-1000 angstroms or preferably about 600, 700, 800 or 900 angstroms. These thickness ranges are preferred if chromium or chromium-nickel alloy comprises the first layer 60. In another embodiment, the first layer 60 preferably has a thickness of 2000-10000 angstroms, preferably 2500-8000 angstroms, preferably 3000-6500 angstroms, preferably 3500-5500 angstroms or preferably about 4000, 4500 or 5000 angstroms. These thickness ranges are preferred if silver comprises the first layer 60. Preferably, the topcoat layer 70 has a thickness of 0.1-10 microns, preferably 1-8 microns, preferably 2-6 microns or preferably about 3-5 microns. These thickness ranges are preferred if chromium or chromium-nickel alloy comprises the topcoat layer 70. In another embodiment, the topcoat layer 70 preferably has a thickness of 50-500 angstroms, preferably 100-400 angstroms, preferably 150-300 angstroms, preferably about 175-275 angstroms or 200-250 angstroms. These thickness ranges are preferred if hydrogenated silicon oxy carbon polymer comprises the topcoat layer 70.

In a preferred embodiment, the first layer 60 is comprised of silver and the topcoat layer 70 is comprised of a polymer material, such as hydrogenated silicon oxy carbon polymer. Silver is useful as an adhesion layer between the current conductor and overlying polymer topcoat layer. Polymer topcoat layers as described herein may exhibit poor adhesion to metal materials, such as molybdenum, which are used to make current conductors. However, silver readily forms an adhesive seal with such current conductors and topcoat polymer layers. Accordingly, it is desirable to utilize silver for the first layer when a polymer material is used as the topcoat layer. It is believed that replacing the silver with other noble metals (such as Pt, Au, Ni, Ru, Rh, etc.) that are compatible with the topcoat can also produce similar results.

Alternatively, the first layer can be chromium 1-5 or 3-4 microns thick, and without a second or other layer. Alternatively, the first layer can be a layer of hydrogenated silicon oxy carbon polymer as described above (or not more than 1 micron thick) and without the presence of a second or other layer. The oxidation-resistant coating, including all layers, is preferably less than 13, 10, 8, 7, 6 or 5 microns thick.

The first layer and topcoat layer (other than as described below) and optionally other layers can be applied by conventional, well-known techniques which include, but are not limited to, sputtering, magnetron sputtering, ion-beam deposition, electron beam evaporation, plasma-enhanced chemical vapor deposition, electroplating and electroless plating. Preferably, each layer of the invented coating is applied using a sputtering process, more preferably a magnetron sputtering process. In another preferred embodiment, when it is desired that chromium or chromium-nickel alloy comprise the first layer and topcoat layer, a magnetron sputtering process is preferred. However, other materials as referenced above, such as silver, can be applied by a sputtering process without the use of magnets, as in magnetron sputtering. The hydrogenated silicon oxy carbon polymer is preferably applied via PECVD (Plasma Enhanced Chemical Vapor Deposition) but can also be deposited by RPCVD (Remote Plasma CVD) and other low temperature deposition processes.

Magnetron sputtering involves placing the coating material (i.e. the "target") and a metallic backing plate on magnets arranged with alternating polarity. For example, the coating material can be chromium and the substrate can be a current conductor. The target and metallic backing plate are placed in a vacuum chamber wherein an inert gas, such as argon, is introduced at a desired flow rate. An electrical current is supplied to the target so that the inert gas ions are attracted to the target at high speeds, thereby ejecting molecules from the target as the inert gas ions collide with the target. The ejected target molecules are then deposited onto the substrate to form a deposited film. Preferably, the sputtering process should be tailored to be pin hole/void free so that complete coverage of the substrate is achieved, even in non-line of sight areas. More preferably, the sputtering process is operated at elevated argon pressures and lower deposition rates (e.g., 0.5-2.5 microns at 4000 sec. for first coat and 1-5 microns at 7000 sec. for topcoat), wherein a multi-step process of applying a plurality of layers is conducted without breaking vacuum in the coating chambers. For example, the argon pressure can be $1\text{-}5\times10^{-3}$ mbar at 3 kW. The argon pressure will depend on the equipment used and the wattage.

Preferably, layers 60 and 70 when applied via sputtering are subject to high energy electron or ion bombardment during sputtering. In a preferred embodiment, the substrate and the oxidation-resistant coating are biased with a high frequency waveform during sputtering to create high energy electron bombardment for coating compaction. For example, radio frequency waveform or other techniques such as high voltage DC biasing accelerates electrons to the deposition substrate and coating and the subsequent momentum transfer assists in coating compaction during the sputtering process. Alternatively a separate electron gun or ion gun or other electron or ion generator may also be used to create a coating compaction effect via momentum transfer. When magnetron or other sputtering is used it can include biasing with radio frequency waveforms or direct current. The radio frequency waveform is preferably applied to the substrate and coating at a power range of about 10-1000 watts, preferably 100-750 watts, preferably 150-500 watts, preferably 200-300 watts or preferably about 220, 240 or 260 watts. The applied radio frequency waveform accelerates electrons in the sputtering plasma to the substrate and coating at a desired rate as the ejected target molecules are deposited onto the surface of the substrate. The high energy electron impact preferably results in a tightly compacted layer of target molecules that is sufficiently free of pinholes or other voids. Applying high energy charged particle bombardment to the substrate and coating has a tendency to force the ejected target molecules into the cracks or uneven spaces located on the surface of the substrate or between the molecules themselves. Moreover, the momentum transfer processes that occur during the high energy particle bombardment on the substrate and coating tend to translate the ejected or disturbed target molecules in the coating on the surface of the substrate so that they become compacted together, wherein the space or voids between the molecules is minimized. As such, the ejected target molecules deposit on the surface of the substrate, underlying layer or each other in a substantially non-porous and void-free manner.

In a preferred embodiment, the invented coating is applied at temperatures below 300-350° C. because current conductors, such as molybdenum foils, can start to oxidize above 300° C. Preferably, the invented coating is applied at a temperature of 25-300° C., preferably 75-275° C., preferably 125-250° C., preferably 150-225° C. or about 180-200° C.

Generally, both layers of the invented coating, the first layer and topcoat layer, are applied in the vacuum chamber under the same process conditions without breaking the vacuum in the chamber. For example, the inert gas flow, deposition pressure, electrical charge, chamber temperature and radio frequency are held constant during the application of each layer. However, in another preferred embodiment, the inert gas flow and associated pressure of the inert gas in the chamber ("deposition pressure") are increased while the first layer of the coating is applied for conformal coverage. For example, the inert gas flow and deposition pressure can be increased by 10%, 20%, 30%, 50%, 70%, or 100%, for the first layer, as contrasted to keeping the conditions noted above constant during the application of both layers. As such, if the first layer is applied under increased inert gas flow and deposition pressure, the topcoat layer is preferably applied under inert gas flow and deposition pressures that are 10%, 20%, 30%, 50%, 70%, or 100% less than said increased conditions. Preferably the layers of material that are applied via sputtering are applied at a deposition pressure of at least 2, 2.5, 3, 4, 5, 6, 7, 10, 15 or 20, $\times10^{-3}$ mbar.

In order to promote a further understanding of the invention, the following examples are provided. These examples are shown by way of illustration and not limitation.

Example 1

A total of 43 outer leads connected to molybdenum foils were coated with the invented coating via magnetron sputtering in a vacuum chamber. A Hauzer Sputtering System coater was used to apply the first layer and topcoat layer. The coating was applied substantially as shown in FIG. 2. Approximately only the first 5-6 mm of the foil, where the foil and outer lead are connected, was coated. FIG. 2 shows a representative portion of the 43 outer leads and foils that were coated. The remaining portion of the foil was not coated. The 43 outer leads and foils were coated with two layers of chromium, wherein 18 were coated with both layers applied under the same process parameters (set 1) and 25 were coated with each layer applied under separate, semi-similar process parameters (set 1 & 2). The vacuum seal of the deposition chamber was never broken as the 43 outer leads and foils were coated with both layers. The process parameter sets used during the coating of the 43 outer leads and foils are as follows:

TABLE 1

| Parameters | Set 1 | Set 2 |
|---|---|---|
| Argon Flow (sccm) | 100 | 150 |
| Deposition Pressure ($10^{-3}$ mbar) | 2.48 | 3.62 |
| Cathode Power (kw) | 2.95 | 2.95 |
| Cathode Voltage (V) | 440 | 420 |
| Cathode Current (A) | 6.7 | 7.0 |
| Radio Frequency Incident Power (w) | 240 | 240 |
| Temperature (° C.) | 180-200 | 180-200 |

As noted above, the coating arrangement for the 43 outer leads and foils was divided into two groups, one containing 18 pieces (group 1) and the other 25 pieces (group 2). The coating process for each group and the parameter set used is as follows:

TABLE 2

| Group | First Layer (500-1000 Å) | Topcoat Layer (3-4 micron) |
|---|---|---|
| 1 (18 pieces) | Set 1 | Set 1 |
| 2 (25 pieces) | Set 2 | Set 1 |

The 43 outer leads and foils coated with the invented coating were used to construct GE Halogen CP60 test capsules. Two groups of GE Halogen CP60 test capsules were constructed (Group 1 and Group 2). The first group of test capsules utilized the outer leads and foils from group 1 of Table 2 above. The second group of test capsules utilized the outer leads and foils from group 2 of Table 2 above. A portion of the test capsules were placed in an oven at 600° C. for 650 hours and another portion was placed in an oven at 650° C. for 700 hours. For comparison to the current state of the art of lamp technology, two sets of commercially available lamps (commercially available halogen lamps having 500° C. rated pinch seals and GE Halogen CP60 capsules from commercially available lamps) were also placed in the ovens along side the test capsules. The results of the oven testing are as follows:

TABLE 3

| Lamp Type | Results | |
|---|---|---|
| | 600° C. Oven | 650° C. Oven |
| GE Halogen CP60 test capsules (Group 1) | No seal failure after 650 hrs | No seal failure after 680 hours |
| GE Halogen CP60 test capsules (Group 2) | No seal failure after 650 hrs | No seal failure after 680 hours |
| Commercially available halogen lamps having 500° C. rated pinch seals | Seals failed at or before 650 hrs | Seals failed at or before 342 hrs |
| GE Halogen CP60 capsules from commercially available lamps | Seals failed at 3-50 hrs | No test conducted (NA) |

As can be seen above in Table 3, it was observed that the seals utilizing the outer leads and foils coated with the invented coating, as applied in Example 1, were able to withstand high temperatures for longer periods of time than both sets of currently available lamps. Furthermore, no bubbles were observed in the pinch seal area. The foils and outer leads of the test capsules exhibited little or no oxidation under the above test conditions, whereas the currently available lamps showed significant signs of oxidation at the pinch seals. These results were both surprising and unexpected.

Example 2

In another experiment, outer leads connected to molybdenum foils were coated with the invented coating via sputtering in a vacuum chamber. A Leybold Dynamet 4V Sputtering System coater was used to apply the first layer and topcoat layer. Again, approximately the first 5-6 mm of the foil, where the foil and outer lead are connected, was coated. The remaining portion of the foil was not coated. The outer leads and foils were coated with two layers, the first layer being silver and the topcoat layer being hydrogenated silicon oxy carbon polymer ($SiO_xH_yC_z$), being Wacker Silicone Fluid AK 0.65 (99%+ HMDSO, <0.5 ppm Cl) supplied by Wacker Chemical Corporation, Adrian, Mich. As seen below in Table 4, the coating of the first layer and the topcoat layer involved a pre-treatment or ramping-up process and a coating process, wherein the pre-treatment or ramping-up and coating process parameters are dissimilar. The pre-treatment portion associated with the first layer was for outer lead and foil surface preparation only. No silver was deposited on the outer leads or foils during the pre-treatment portion of the process. Similarly, the pre-treatment portion associated with the topcoat layer was for ramping-up the power source to the desired cathode power. No hydrogenated silicon oxy carbon polymer was deposited during the pre-treatment portion of the process. The vacuum seal of the deposition chamber was never broken as the outer leads and foils were coated with both layers. The parameters used during the coating of the outer leads and foils are as follows:

TABLE 4

| | First Layer (4500 Å) Silver | Topcoat Layer (200 Å) Hydrogenated Silicon Oxy Carbon Polymer |
|---|---|---|
| Pre-Treatment Parameters | | |
| Flow (sscm) | 200 (Oxygen) | 35-65 (HMDSO—hexamethyldisiloxane) |
| Cathode Power (kw) | 4 | 0.6-1.6 |
| Temperature (° C.) | 180-200 | 180-200 |
| Time (sec) | 20 | 2 |
| Coating Parameters | | |
| Flow (sscm) | 500 (Argon) | 65 (HMDSO) |
| Cathode Power (kw) | 74 | 1.6 |
| Temperature (° C.) | 180-200 | 180-200 |
| Time (sec) | 9 | 6 |

The outer lead and foils coated per Table 4 were used to construct GE Halogen CP60 test capsules. A portion of the test capsules were placed in an oven at 600° C. for 650 hours and another portion was placed in an oven at 650° C. for 1300 hours. For comparison to the current state of the art of lamp technology, two sets of commercially available lamps (commercially available halogen lamps having 500° C. rated pinch seals and GE Halogen CP60 capsules from commercially available lamps), were also placed in the ovens along side the test capsules. The results of the oven testing are as follows:

TABLE 5

| Lamp Type | Results | |
|---|---|---|
| | 600° C. Oven | 650° C. Oven |
| GE Halogen CP60 test capsules | No seal failure after 650 hrs | No seal failure at 1300 hrs |
| Commercially available halogen lamps having 500° C. rated pinch seals | Seals failed at or before 650 hrs | Seals failed at or before 342 hrs |
| GE Halogen CP60 capsules from commercially available lamps | Seals failed at 3-50 hrs | No test conducted (NA) |

As can be seen above in Table 5, it was observed that the seals utilizing the outer leads and foils coated with the invented coating, as applied in Example 2, were able to withstand high temperatures for longer periods of time than both sets of currently available lamps. For example, the seals didn't fail after more than 650 hours at a temperature of about 600 and 650° C. at the outer lead-seal foil junction. Furthermore, no bubbles were observed in the pinch seal area. The foils and outer leads of the test lamps exhibited little or no oxidation under the above test conditions, whereas the currently available lamps showed significant signs of oxidation at the pinch seals. These results were surprising and unexpected.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electric lamp comprising an electric light source and a current conductor connected to said electric light source, said current conductor comprising an outer lead joined to a seal foil at an outer lead-seal junction, a first section of said current conductor including said junction being sealed with an outer seal material, and first section of said current conductor inside said outer seal material being coated with an oxidation-resistant coating comprising a first layer and a topcoat layer overlying said first layer, said first layer or said topcoat layer comprising hydrogenated silicon oxy carbon polymer.

2. The lamp of claim 1, wherein said oxidation-resistant coating comprises a layer of not more than 10 microns thick applied via sputtering wherein said layer of material is subject to high energy electron or ion bombardment during sputtering.

3. The lamp of claim 2, wherein said sputtering includes biasing with radio frequency waveforms or direct current.

4. The lamp of claim 2 wherein said layer of material applied via sputtering is applied at a deposition pressure of at least $2.5\times10^{3}$ mbar.

5. The lamp of claim 1, said topcoat layer comprising hydrogenated silicon oxy carbon polymer, said topcoat layer being not more than 1 micron thick.

6. The lamp of claim 1 wherein said first layer is made from a material selected from chromium, chromium nickel alloy, and silver, and said topcoat layer is made from hydrogenated silicon oxy carbon polymer.

7. The lamp of claim 1, wherein said topcoat layer is made from a material selected from chromium, chromium-nickel alloy, and silver, and said first layer is made from hydrogenated silicon oxy carbon polymer.

8. The lamp of claim 1, said oxidation resistant coating covering at least 50% of the length of said seal foil.

9. The lamp of claim 1, said lamp being capable of operating at a temperature of about 600° C. for more than 650 hours without said seal failing.

10. The lamp of claim 1, at least one of said first layer and said topcoat layer of said oxidation-resistant coating being deposited via magnetron sputtering.

11. The lamp of claim 10 wherein said magnetron sputtering includes biasing with radio frequency wave forms or direct current.

12. The lamp of claim 1, at least one of said first layer and said topcoat layer of said oxidation resistant coating being deposited via sputtering at a temperature of 25-300° C.

13. The lamp of claim 1, said lamp being designed to operate at a wattage of 400-3000 watts.

14. The lamp of claim 1, in which said electric light source is an arc chamber.

15. The lamp of claim 1, said oxidation-resistant coating having a thickness of not more than 13 microns.

* * * * *